US006539921B1

(12) United States Patent
Matsumura

(10) Patent No.: US 6,539,921 B1
(45) Date of Patent: Apr. 1, 2003

(54) FUEL INJECTION SYSTEM WITH FUEL PRESSURE SENSOR

(75) Inventor: Toshimi Matsumura, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/284,212

(22) Filed: Oct. 31, 2002

(30) Foreign Application Priority Data

Nov. 6, 2001 (JP) ..... 2001-341053
Jul. 26, 2002 (JP) ..... 2002-218145

(51) Int. Cl.[7] ..... F02M 37/04

(52) U.S. Cl. ..... 123/456; 123/494; 73/119 A; 73/708

(58) Field of Search ..... 123/357, 456, 123/479, 494, 198 D; 73/119 A, 700, 708, 714

(56) References Cited

U.S. PATENT DOCUMENTS 4,261,209 A * 4/1981 Hatsuno et al. ..... 73/119 A
4,714,998 A * 12/1987 Bussey et al. ..... 73/119 A
4,790,277 A * 12/1988 Schechter ..... 73/119 A
5,426,971 A * 6/1995 Glidewell et al. ..... 73/19.05
5,499,538 A * 3/1996 Glidewell et al. ..... 73/119 A
6,234,148 B1 * 5/2001 Hartke et al. ..... 123/447

FOREIGN PATENT DOCUMENTS

JP 10-54317 2/1998
JP 11-62692 3/1999

* cited by examiner

*Primary Examiner*—Carl S. Miller
(74) *Attorney, Agent, or Firm*—Nixon & Vanderhye P.C.

(57) ABSTRACT

The ECU controls at least one component of a fuel injection system by outputting a control signal in accordance with a fuel pressure. The ECU is initially designed based on a basic pattern of an output characteristic of a common rail pressure sensor defined between a fuel pressure and an output signal. The output characteristic may vary in each sensor element. The ECU detects an output signal corresponding to an atmospheric pressure to determine and learn the actual output characteristic of the common rail sensor, and corrects a control characteristic for the component in accordance with the leaned actual output characteristic. For example, the ECU changes the output characteristic to the learned one. Control accuracy in a common rail fuel injection system can considerably be improved while achieving a considerable reduction in cost of fabricating the common rail pressure sensor.

15 Claims, 7 Drawing Sheets

FUEL INJECTION SYSTEM WITH FUEL PRESSURE SENSOR

CROSS REFERENCE TO RELATED APPLICATION

This application is based on Japanese Patent Applications No. 2001-341053 filed on Nov. 6, 2001 and No. 2002-218145 filed on Jul. 26, 2002 the contents of which are incorporated herein by reference.

BACKGROUND OF THE INVENTION

1. Field of the Invention

The present invention relates to a fuel injection system with a fuel pressure sensor for detecting a pressure in an accumulator for pressurized fuel. Specifically, the present invention relates to a method and a system for learning and correcting an output characteristic of the fuel pressure sensor of the fuel injection system with the accumulator. The present invention may apply to a fuel injection system for injecting high pressure fuel accumulated in a common rail to an engine via an injector.

2. Related Art

Conventionally, a common rail fuel injection system is known as an accumulator fuel injection system. The system has a high pressure supply pump driven to rotate by a multi-cylinder diesel engine or the like. The pump is designed for pressurizing fuel and supply pressurized fuel to a common rail as an accumulator. The common rail accumulates high pressure fuel and distributes the high pressure fuel accumulated in the common rail to injectors. The injectors are mounted on respective cylinders of the multi-cylinder engine. The injectors inject the high pressure fuel accumulated in the common rail into respective combustion chambers of the cylinders.

According to the common rail fuel injection system, fuel pressure in the common rail is detected by a fuel pressure sensor. The fuel pressure in the common rail may be referred to as an actual common rail pressure. A supply amount of the high pressure supply pump is controlled by a feedback control such that the actual common rail pressure substantially coincides with a target common rail pressure. The target common rail pressure is set based on operating conditions of the multi-cylinder engine. Each of the fuel pressure sensors has an individual output characteristic. Therefore, each output of the fuel pressure sensors has a deviation from a reference output. Such the deviation can be suppressed in the manufacturing process of the fuel pressure sensor by narrowing a tolerance and managing severely. For example, in order to improve control accuracies of the common rail pressure, the accuracy of the single product of the fuel pressure sensor is severely adjusted within a narrowly set tolerance range.

However, according to the conventional common rail fuel injection system, there poses a problem that the tolerance of the fuel pressure sensor permitted during the manufacturing process constitutes the accuracy in controlling the system. Therefore, in order to improve the control accuracy, it is necessary to further improve the accuracy of the single product per se of the fuel pressure sensor. Such the improvement may increase the cost of manufacturing the fuel pressure sensor.

SUMMARY OF THE INVENTION

It is an object of the present invention to provide a fuel injection system that is capable of controlling a fuel injection system based on a fuel pressure in an accumulator accurately.

It is another object of the present invention to provide a fuel injection system that is capable of controlling a fuel pressure in an accumulator accurately.

It is a still another object of the present invention to provide a fuel injection system that is capable of reducing an influence of a deviation of a fuel pressure sensor on a fuel pressure control accuracy.

It is a yet another object of the present invention to provide a fuel injection system that is capable of significantly improving control accuracy of a system while considerably reducing cost of fabricating a fuel pressure sensor by learning and correcting a deviation in a characteristic of the fuel pressure sensor.

According to a first aspect of the present invention, a fuel injection system comprises a fuel pressure sensor and a controller operatively connected with the fuel pressure sensor. The fuel pressure sensor outputs an output signal indicative of a fuel pressure. The output signal and the fuel pressure defines an actual pattern of the output characteristic which may be varied from a basic pattern of the output characteristic. The controller controls at least one of components of the fuel injection system in response to the output signal of the fuel pressure sensor. The controller includes learning means and correcting means. The learning means detects the output signal corresponding to an atmospheric pressure which is outputted when the fuel pressure is expected to be lowered to an atmospheric pressure and learns the actual pattern of the output characteristic of the fuel pressure sensor based on the output signal corresponding to an atmospheric pressure. The correcting means corrects a control characteristic between the output signal and a control signal for the component based on the actual pattern of the output characteristic learned in the learning means. The control signal is determined in response to the output signal of the fuel pressure sensor so that the controller controls the component in an appropriate manner. As a result, it is possible to improve control accuracy even if the output characteristic of the fuel pressure sensor is varied in each sensor.

The output signal corresponding to the atmospheric pressure may be outputted while the engine is stopped. Further, The output signal corresponding to the atmospheric pressure may be outputted while the engine is stopped and a predetermined condition is satisfied. For example, the predetermined condition may be satisfied when the fuel pressure is lowered to an atmospheric pressure after stopping the engine. For example, the predetermined condition may be satisfied when a predetermined time period is elapsed after stopping the engine. For example, the predetermined condition may be satisfied when an amount of lowering an engine cooling water temperature or an intake temperature or a fuel temperature or an engine oil temperature after stopping the engine is equal to or larger than a predetermined value. The output signal corresponding to the atmospheric pressure may be outputted while the engine is stopped and in starting the engine after the predetermined condition has been satisfied. In addition, the correcting means may include output characteristic storing means and output characteristic changing means. The output characteristic storing means stores the output characteristic of the fuel pressure sensor. The controller is arranged to be responsive to the output characteristic stored in the output characteristic storing means. The output characteristic changing means changes the output characteristic based on the output characteristic learned in the learning means. The output characteristic storing means may initially store a basic pattern of the output characteristic, and the output characteristic changing means may change the output characteristic from the basic pattern to a learned pattern.

According to a second aspect of the present invention, by measuring a detected value of the fuel pressure sensor when the fuel pressure is lowered to an atmospheric pressure after stopping the engine, or when a predetermined time period is elapsed after stopping the engine, or when an amount of lowering an engine cooling water temperature or an intake temperature or a fuel temperature or an engine oil temperature after stopping the engine is equal to or larger than a predetermined value, inputting the measured detected value as a learning value in correspondence with the atmospheric pressure, and changing the basic pattern of the output characteristic of the fuel pressure sensor stored to the output characteristic storing means to a pattern after learning having an output characteristic using the learning value in correspondence with the atmospheric pressure inputted in stopping the engine. Therefore, it is not necessary to control accuracy of the fuel pressure sensor severely during the manufacturing and fabricating process. As a result, a considerable reduction in cost of fabricating the fuel pressure sensor can be achieved. Further, a deviation of the characteristic from a basic pattern of an output characteristic of a single product per se of the fuel pressure sensor can be learnt and corrected and therefore, control accuracy in the system can considerably be improved.

According to a third aspect of the present invention, by measuring a detected value of the fuel pressure sensor in starting the engine after the fuel pressure has been lowered to an atmospheric pressure after stopping the engine, or after a predetermined time period has elapsed after stopping the engine, or after an amount of lowering an engine cooling water temperature or an intake temperature or a fuel temperature or an engine oil temperature after stopping the engine has become equal to or larger than a predetermined value, inputting the measured detected value as a learning value in correspondence with the atmospheric pressure, and changing the basic pattern of an output characteristic of the fuel pressure sensor stored to the output characteristic storing means to a pattern after learning having an output characteristic using the learning value in correspondence with the atmospheric pressure inputted in starting the engine. Therefore, it is not necessary to control accuracy of the fuel pressure sensor severely during the manufacturing and fabricating process. As a result, a considerable reduction in cost of fabricating the fuel pressure sensor can be achieved. Further, a deviation of the characteristic from a basic pattern of an output characteristic of a single product per se of the fuel pressure sensor can be learnt and corrected and therefore, control accuracy in the system can considerably be improved.

In the present invention, the following exemplified arrangement may be advantageous in enhancing the advantages of the present invention. For example, a timing of starting the engine after the fuel pressure has been lowered to the atmospheric pressure after stopping the engine, or after the predetermined time period has elapsed after stopping the engine, or after the amount of lowering the engine cooling water temperature or the intake temperature or the fuel temperature or the engine oil temperature after stopping the engine becomes equal to or larger than the predetermined value, ay be indicated by a condition in which the ignition switch is made ON, electricity conduction to the starter is stopped and the learning permitting flag is made ON.

According to another exemplified arrangement of the present invention, the system converts the detected value of the fuel pressure sensor to the learning value in correspondence with the pattern after learning during operating the engine. The system inputs the learning value converted from the detected value. The system leans a deviation of the characteristic from the basic pattern of an output characteristic of a single product per se of the fuel pressure sensor, and corrects the output characteristic. The system reflects the detected value after learning and correcting to the control thereafter. For example, the system reflects the detected value corrected based on the learned amount to a common rail pressure control. Therefore, control accuracy in the system can considerably be improved. Additionally, it is possible to achieve a considerable reduction in cost of the fuel pressure sensor.

According to another exemplified arrangement of the present invention, the control performed after the learning and correcting procedure is a control for controlling a supply amount of the fuel supply pump by a feedback control such that an actual common rail pressure detected by the fuel pressure sensor substantially coincides with a target common rail pressure determined in accordance with an operating condition or an operating state of the engine. Thereby, the supply amount of the fuel supply pump, that is, the pressure of the fuel supplied from the fuel supply pump to the common rail, can accurately be proximate to a target common rail pressure determined in accordance with the operating condition or the operating state of the engine.

According to another exemplified arrangement of the present invention, the basic pattern of the output characteristic of the fuel pressure sensor is characterized in an output characteristic raised to the right before learning and correcting passing two points of an initial value in correspondence with the atmospheric pressure in stopping the engine and a high pressure side target value within a normally used range of the fuel pressure sensor. Further, as the high pressure side target value within the normally used range of the fuel pressure sensor, it is advantageous in forming the basic pattern to use a maximum value within the normally used range of the output characteristic of the fuel pressure sensor.

According to another exemplified arrangement of the present invention, the pattern after leaning of the output characteristic of the fuel pressure sensor is characterized in an output characteristic after leaning and correcting in which an inclination of the basic pattern of the output characteristic of the fuel pressure sensor is changed to pass two points of the learning value in correspondence with the atmospheric pressure inputted in stopping the engine and the high pressure side target value within the normally used range of the fuel pressure sensor. Further, as the high pressure side target value within the normally used range of the fuel pressure sensor, it is very advantageous in forming the pattern after learning to use a maximum value within the normally used range of the output characteristic of the fuel pressure sensor.

According to another exemplified arrangement of the present invention, the pattern after learning of the output characteristic of the fuel pressure sensor is characterized in an output characteristic after learning and correcting in which an inclination thereof is changed to pass two points of the learning value in correspondence with the atmospheric pressure inputted in stopping the engine and a value of an upper side of the high pressure side aimed value within the normally used range of the fuel pressure sensor.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

First Embodiment

Figure 1:
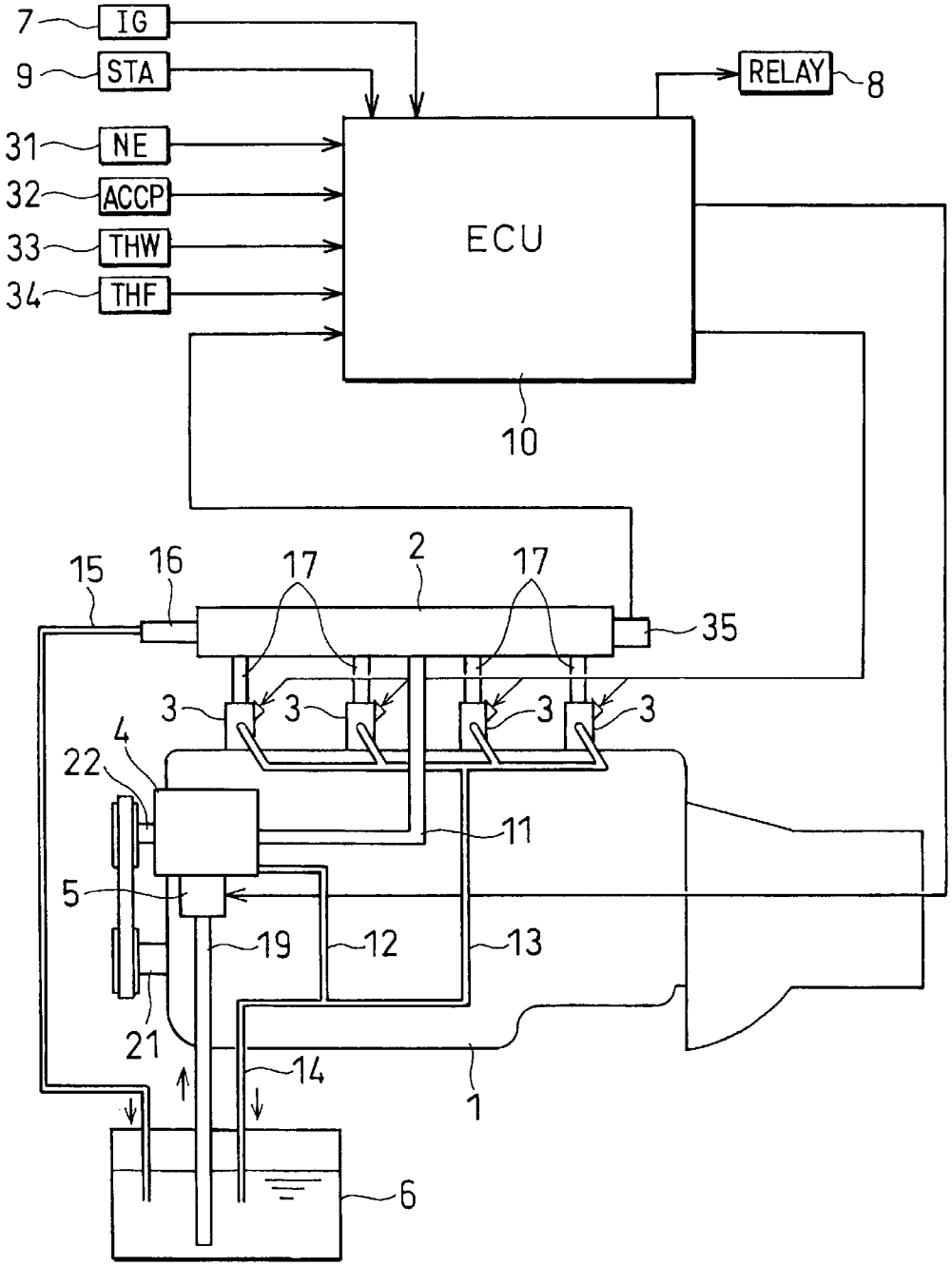
FIG. 1 is a block diagram showing a total structure of a common rail fuel injection system according to a first embodiment of the present invention.

FIG. 1 through FIG. 4 show a first embodiment of the present invention. In the first embodiment, the present invention is applied to a common rail fuel injection system that has a fuel pressure sensor for detecting a fuel pressure in a common rail and for outputting signal indicative of detected fuel pressure.

A common rail fuel injection system of the embodiment is provided with a common rail 2 as an accumulator for accumulating high pressure fuel that corresponds to a fuel injection pressure for injecting and supplying into combustion chambers of respective cylinders of an internal combustion engine 1. The internal combustion engine 1 is a multi-cylinder diesel engine or the like. Hereinafter the multi-cylinder diesel engine is referred to as an engine. The system further has a plurality of pieces (4 pieces according to the embodiment) of injector 3 mounted to the respective cylinders. The system has a supply pump 4 for pressurizing fuel and feeding the pressurized fuel to the common rail 2. The supply pump 4 has a pressurizing chamber which introduces fuel via a suction control valve 5. The system has an engine control unit 10 for electronically controlling actuators of the plurality of pieces of injector 3 and an actuator of the supply pump 4. The engine control unit 10 is referred to as an ECU or just a controller. The ECU 10 provides means for learning and correcting an output characteristic of fuel pressure sensor.

The common rail 2 needs to continuously accumulate the high pressure fuel that corresponds to the fuel injection pressure. Therefore, the common rail 2 is connected to a delivery port of the supply pump 4 to receive the high pressure fuel via a fuel pipe 11. The fuel pipe 11 provides a high pressure path. Leaked fuel from the injectors 3 and the supply pump 4 is returned to a fuel tank 6 via leak pipes 12, 13 and 14. The leak pipes provides fuel return paths. Further, a pressure limiter 16 for limiting the fuel pressure is mounted on an end of the common rail 2. The pressure limiter 16 may discharge fuel if the fuel pressure exceeds upper limit. A return pipe 15 is disposed between the pressure limiter 16 and the fuel tank 6 to return the discharged fuel. The return pipe 15 provides a fuel return path. The pressure limiter 16 is a pressure safety valve for limiting fuel pressure to be equal to or lower than limit set pressure. The pressure limiter 16 opens and discharges fuel from the common rail 2 when the fuel pressure in the common rail 2 exceeds the limit set pressure.

The injector 3 of each of the cylinders is an electromagnetic fuel injection valve. The injector 3 has a fuel injection nozzle connected to a downstream end of each of a plurality of branch pipes 17 branched from the common rail 2 for injecting to supply high pressure fuel accumulated in the common rail 2 into a combustion chamber of each of the cylinders of the engine 1. The injector 3 has an electromagnetic actuator (not illustrated) for driving a nozzle needle contained in the fuel injection nozzle in a valve opening direction. The injector 3 has needle urging means (not illustrated) for urging the nozzle needle in a valve closing direction. Further, injection of fuel from the injector 3 of each of the cylinders into the combustion chamber of each of the cylinders of the engine 1, is electronically controlled by conducting electricity (ON) and stopping to conduct electricity (OFF) to an injection control electromagnetic valve as the electromagnetic actuator connected to the downstream end of each of the branch pipes 17. That is, during a period of time in which the injection control electromagnetic valve of the injector 3 of each of the cylinders is opened, the high pressure fuel accumulated in the common rail 2 is injected and supplied to the combustion chamber of the respective cylinder of the engine 1.

The supply pump 4 includes a well-known feed pump that is also called as a low pressure supply pump (not illustrated). The feed pump is driven and rotated by a pump drive shaft 22 transmitting rotation of a crankshaft 21 of the engine 1, and sucks up fuel in the fuel tank 6 into the supply pump 4. The supply pump 4 has a plunger (not illustrated) driven by the pump drive shaft 22, and a pressurizing chamber for pressurizing fuel by reciprocal movement of the plunger. The pressurizing chamber may be called as a plunger chamber. The supply pump 4 is designed as a high pressure supply pump for pressurizing fuel sucked by the feed pump via a fuel pipe 19 and delivering high pressure fuel from a delivery port to the common rail 2. The supply pump 4 may be called as a fuel supply pump. The suction control valve 5 is disposed on a fuel flow path from the feed pump of the supply pump 4 to the pressurizing chamber. The suction control valve 5 is referred to as an SCV. The SCV 5 is provided as an electromagnetic actuator for controlling the fuel pressure in the common rail. The SCV 5 controls an amount of fuel introduced into the pressurizing chamber by opening and closing the fuel flow path.

The SCV 5 is a pump flow rate control valve for controlling a suction amount of fuel sucked from the feed pump of the supply pump 4 into the pressurizing chamber by being electronically controlled by a pump drive signal from the ECU 10. The pump drive signal is supplied from the ECU 10 via a pump drive circuit, not illustrated. The SCV 5 changes fuel injection pressure of fuel injected and supplied from the respective injector 3 to the engine 1, that is, the common rail pressure. The SCV 5 may be called as a pump control valve or a suction amount controlling electromagnetic valve. Here, the SCV 5 of the embodiment is a normally open type electromagnetic valve. The SCV 5 includes valve components such as a valve and a valve body for defining a fuel flow path therebetween and for changing an opening degree of the fuel flow path in accordance with relative location of the valve and the valve body. The SCV 5 further includes a solenoid coil for driving the valve components to control the opening degree of the valve in accordance with the pump drive signal. The valve opening degree is brought into a fully opened state when electricity conduction to the solenoid coil is stopped.

The ECU 10 is provided with a microcomputer having a well-known structure. For example, the ECU 10 has a CPU for executing control processings and operation processings, a memory (ROM, backup RAM) for holding various programs and data, an input circuit, an output circuit, a power source circuit, an injector drive circuit (EDU), a pump drive circuit and the like. Here, backup RAM constitutes output characteristic storing means.

Further, the ECU 10 of the embodiment includes an IG signal detecting means for detecting an ON (IG/ON) signal or an OFF (IG/OFF) signal of an ignition switch 7. The ECU 10 has a main relay drive means for controlling a main relay 8. The main relay 8 connects and disconnects a line for supplying power to the ECU 10. The line is a power source supply line provided between the ECU 10 and a battery. The ECU 10 makes the main relay ON when the IG/ON signal is detected by the IG/ON signal detecting means. The IG/ON signal detecting means and the main relay drive means are operable even when the power source is not supplied to the microcomputer.

The ECU 10 keeps the main relay ON for a certain period from turning off the ignition switch 7. Therefore, the ECU 10 itself can continue to carry out the processing after the IG/OFF is detected. When the ignition switch 7 is made OFF (IG/OFF) suddenly by an operator, the main relay drive means can delay opening (OFF) of the main relay 8 until a predetermined condition is satisfied. The predetermined condition is satisfied until the engine 1 is stopped since the ignition switch 7 has been made OFF, or until a predetermined time period elapses since the ignition switch 7 has been made OFF. The operator may be a driver of a vehicle.

Further, the ECU 10 has a starter STA signal detecting means for detecting a starter ON signal (STA/ON) and a starter OFF signal (STA/OFF) based on a condition of a starter switch 9. The starter switch 9 is connected to a starter motor for the engine 1. The starter switch 9 enables power supply to the starter motor when the starter switch 9 is made ON (STA/ON).

The ignition switch 7 and the starter switch 9 are operatively connected with an engine key switch located in a vehicle compartment. The ignition switch 7 is turned on when a key is inserted into a key cylinder and rotated to an IG position and an ACC position. The starter switch 8 is turned on when the key is rotated to an ST position.

Further, the ECU 10 is constituted such that when the engine 1 is cranked, thereafter, the key is returned to the IG position and the ignition switch 7 is made ON (IG/ON), then the ECU power source is supplied continuously. Then, the ECU 10 executes predetermined controls based on control programs stored in the memory. For example, the ECU 10 executes controls for actuators of various control parts such as the injectors 3, the supply pump 4 and the like.

Further, the ECU 10 is constituted such that when the ignition switch is made OFF (IG/OFF) and supply of ECU power source is cut, the above-described control based on the control programs stored in the memory is forcibly finished.

The ECU 10 further includes an A/D converter for inputting several sensor signals from sensors. The ECU 10 is connected with the sensors 31, 32, 33, and 34. A rotational speed sensor 31 detects an engine rotational speed NE. The engine rotational speed may be hereinafter referred to as an engine speed or an engine rotational number. An accelerator opening degree sensor 32 detects an accelerator opening degree ACCP. A cooling water temperature sensor 33 detects an engine cooling water temperature THW. A fuel temperature sensor 34 is disposed on a suction side of the supply pump 4, and detects a fuel temperature THF. A common rail pressure sensor 35 detects a fuel pressure in the common rail 2. The detected pressure by the common rail pressure sensor 35 corresponds to a fuel injection pressure. The common rail pressure sensor 35 may be referred to as a fuel pressure sensor. The ECU 10 inputs other sensor signals such as an operating condition detecting means for detecting an operating state or an operating condition of the engine 1. The operating condition of the engine 1 such as a load of the engine 1 may be indicated based on the output signals of the rotational speed sensor 31 and the accelerator opening degree sensor 32.

Further, the ECU 10 includes basic injection amount determining means for calculating an optimum basic injection amount Q based on the engine rotational number NE and the accelerator opening degree ACCP and a characteristic map. The characteristic map is determined experimentally. The ECU 10 includes an instructed injection amount determining means for calculating an instructed injection amount QFIN by adding an injection amount correcting amount to the basic injection amount Q. The injection amount correcting amount is determined based on the operating conditions of the engine 1 such as the engine cooling water temperature THW, the fuel temperature TFH on the pump suction side and the like. The ECU 10 includes an injection timing determining means for calculating an instructed injection timing T based on the engine rotational number NE and the instructed injection amount QFIN. The ECU 10 includes an injection time period determining means for calculating an electricity conducting time period of the injection control electromagnetic valve of the injector 3 based on the actual common rail pressure Pc, the instructed injection amount QFIN and a characteristic map. The characteristic map may be determined experimentally. For example, the electricity conducting time period may be called as an injector control amount, or an injector control instructed value, or an injection pulse length, or an injection pulse width, or an injection pulse time, or an instructed injection time period. The ECU 10 includes an injector driving means for applying pulse-like injector drive current to the injection control electromagnetic valve of the injector 3 of the respective cylinder via the injector drive circuit. The drive current may be called as an injector drive current value, or an injector injection pulse. The injector drive circuit may be referred to as an EDU.

That is, the ECU 10 is constituted to calculate the instructed injection amount QFIN based on engine operation information such as the engine rotational number NE detected by the rotational speed sensor 31, the accelerator opening degree ACCP detected by the accelerator opening degree sensor 32 and the like. The ECU 10 is constituted to apply the injector injection pulse to the injection control electromagnetic valve of the injector 3 of the respective cylinder in accordance with the injection pulse width calculated based on the operating condition of the engine 1 or the fuel injection pressure and the instructed injection amount QFIN. Thereby, the engine 1 is operated adequately.

The ECU 10 includes delivery amount controlling means for calculating optimum common rail pressure in accordance with the operating condition of the engine 1 and driving the suction control valve 5 of the supply pump 4 via the pump drive circuit. That is, the ECU 10 is constituted to calculate target common rail pressure Pt in consideration of the engine operation information such as the engine rotational number NE detected by the rotational speed sensor 31, the accelerator opening degree ACCP detected by the accelerator opening degree sensor 32 and the like. Further, in calculation of the target common rail pressure Pt, the engine cooling water temperature THW detected by the cooling water temperature sensor 33 and the fuel temperature THF on the pump suction side detected by the fuel temperature sensor 34 are considered as corrective amounts. The ECU 10 is constituted to control the pump drive signal applied to the suction control valve 5 of the supply pump 4 to thereby control a pressure-feed amount of fuel delivered from the supply pump 4 in order to achieve the target common rail pressure Pt. The pump drive signal may be called as an SCV control amount, or an SCV control instructed value, or a drive current value.

Here, according to the embodiment, the instructed injection amount QFIN, the instructed injection timing T and the target common rail pressure Pt are calculated and determined by using the rotational speed sensor 31, the accelerator opening degree sensor 32, the cooling water temperature sensor 33 and the fuel temperature sensor 34 as operating condition detecting means for detecting the operating condition of the engine 1. Alternatively, the instructed injection amount QFIN, the instructed injection timing T and the target common rail pressure Pt may be corrected in consideration of other engine operation information. The other operation information may be indicated by detected signals of other sensors. For example, a suction temperature sensor, a suction pressure sensor, a cylinder determining sensor, an injection timing sensor and the like may be used as operating condition detecting means.

Further, more preferably, it is preferable to control the pump drive signal to the solenoid coil of the suction control valve 5 of the supply pump 4 by feedback control employing the common rail pressure sensor 35 attached on the common rail 2. The feedback control is executed so that the actual common rail pressure Pc detected by the common rail pressure sensor 35 substantially coincides with the target common rail pressure Pt determined based on the operating condition or the operating state of the engine 1. The common rail pressure sensor 35 may be a strain gage type pressure sensor. The ECU 10 may control the SCV control amount, or the SCV control instructed value, or the drive current value.

Further, it is preferable to control the drive current value to the solenoid coil of the suction control valve 5 in a duty control manner. Such a modulated duty signal may be referred to as a DUTY. For example, highly accurate digital control can be carried out by using the duty control for changing the valve opening degree of the valve of the suction control valve 5 by controlling a duty ratio of ON/OFF of the pump drive signal per unit time in accordance with pressure deviation AP between the actual common rail pressure Pc and the target common rail pressure Pt. The DUTY indicates a rate of time for conducting electricity.

Figure 2:
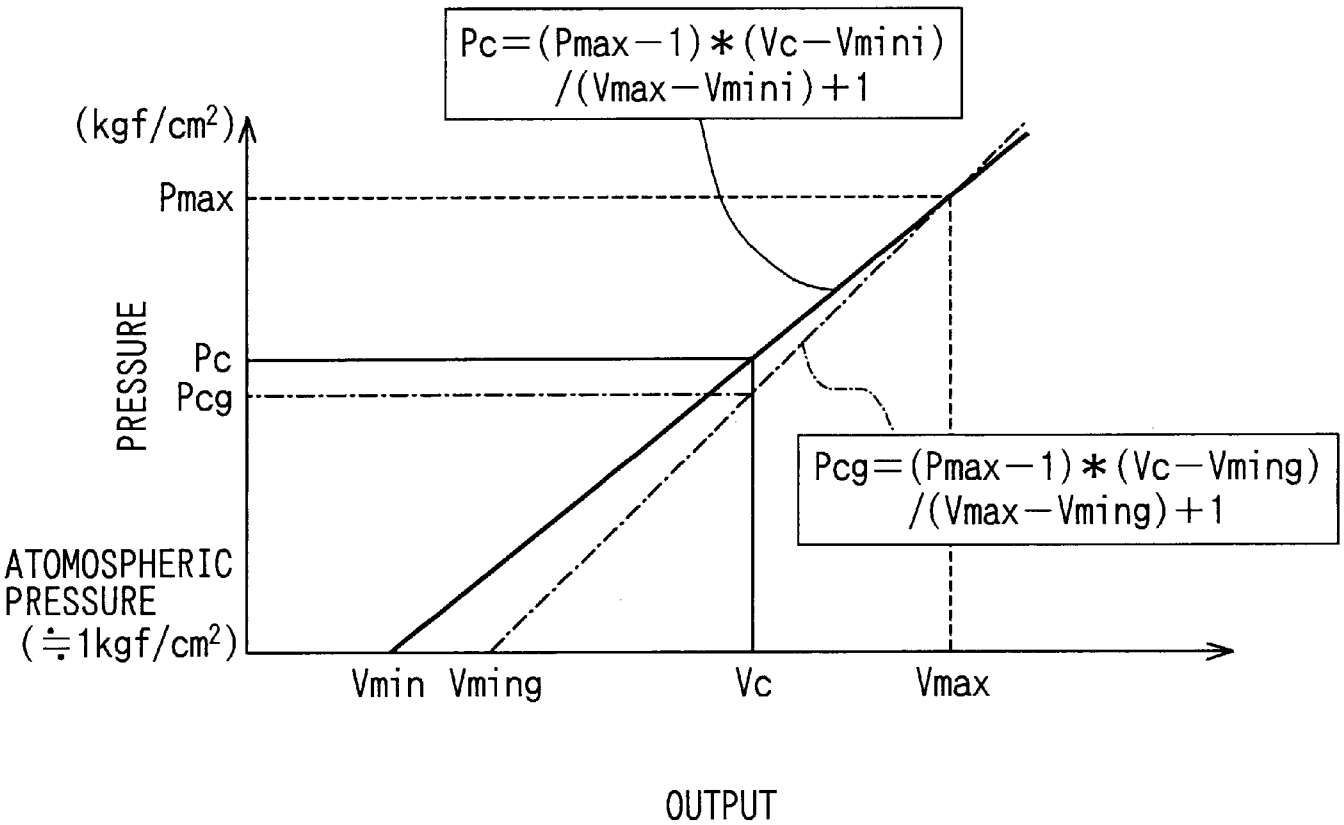
FIG. 2 is a graph showing relationships between a pressure and an output of a common rail pressure sensor according to the first embodiment of the present invention.

Further, as shown by a characteristic diagram of FIG. 2, the common rail pressure sensor 35 outputs an electric signal, that is, a common rail pressure output value Vc. The common rail pressure output value Vc is proportional to the actual common rail pressure Pc. Therefore, the ECU 10 includes common rail pressure detecting means for calculating the actual common rail pressure Pc from the common rail pressure output value Vc generated by the common rail pressure sensor 35.

Further, as shown by the characteristic diagram of FIG. 2, the ECU 10 includes output characteristic changing means that determines an output voltage characteristic of the common rail pressure sensor 35 based on an actual output voltage of the common rail sensor 35 when the system is in a predetermined condition. For example, the output voltage characteristic of the common rail pressure sensor 35 may be determined based on an output voltage of the common rail pressure sensor 35 when the fuel pressure in the common rail is expected to be an atmospheric pressure. Further, the output voltage characteristic of the common rail pressure sensor 35 may be determined based on an output voltage of the common rail pressure sensor 35 when the fuel pressure in the common rail is expected to be a pressurized maximum pressure such as a maximum pressure defined by the pressure limiter 16. The output voltage characteristic of the common rail pressure sensor 35 may be determined based on at least two output voltages of the common rail pressure sensor 35 when the fuel pressure in the common rail is expected to be respective reference pressures.

The output characteristic changing means may change the output voltage characteristic of the common rail pressure sensor 35 in response to a specific signal or interval. For example, the output characteristic changing means may have an initial output voltage characteristic of the common rail pressure sensor 35 that is initially memorized in the ECU 10. The ECU 10 uses the initial output voltage characteristic to convert the output voltage into pressure when the system is first activated. For example, the ECU 10, controls SCV by using the initial output voltage characteristic. Then, when the system first experiences the certain condition, the output characteristic changing means learns an actual output voltage characteristic of the common rail pressure sensor 35. The output characteristic changing means may renew the initial output voltage characteristic by the learned actual output voltage characteristic, or switches the output voltage characteristic used by the ECU 10 from the initial output voltage characteristic to the learned actual output voltage characteristic. The initial output voltage characteristic may be referred to as a basic pattern or an original pattern. The actual output voltage characteristic learned by the output characteristic changing means may be referred to as a pattern after learning. Therefore, the ECU 10 reflects the changed output voltage characteristic to the delivery amount control, that is SCV control thereafter.

The basic pattern of the output characteristic of the common rail pressure sensor 35 is previously stored in the backup RAM of the ECU 10. Here, as shown by a bold line in the characteristic diagram of FIG. 2, the basic pattern of the output characteristic is an output characteristic before leaning and correcting. The basic pattern is raised to the right. The basic pattern passes two points. The first point is an initial value Vmini in correspondence with the atmospheric pressure which can be obtained when the engine is stopped. The second point is a maximum value Vmax in a normally used range of the common rail pressure sensor 35.

Further, a pattern after learning the output characteristic of the common rail pressure sensor 35 is also stored in the backup RAM after learning. As shown by a one-dotted chain line in the characteristic diagram of FIG. 2, the pattern after learning is raised to the right. The pattern after learning has a different inclination from the basic pattern. The pattern after learning passes two points. The first point is a learned value vming in correspondence with the atmospheric pressure inputted when the engine is stopped. The second point is the above-described maximum value Vmax.

The output characteristic changing means may be referred to as a control characteristic correcting means for correcting a control characteristic of control executed by the ECU 10 based on the leaned output voltage characteristic of the common rail pressure sensor 35. In this embodiment, the ECU 10 executes several control processing such as an SCV control that are designed based on the basic pattern of the output voltage characteristic. The ECU 10 leans a pattern of an actual output voltage characteristic of the connected common rail pressure sensor 35. Then the ECU 10 changes the output voltage characteristic from the basic pattern to the learned pattern. Thereafter, the ECU 10 executes the controls such as the SCV control based on the learned pattern. As a result, the control characteristic of the controls executed by the ECU 10 is corrected based on the learned pattern.

Further, the ECU 10 stops an operation of the engine 1 when the common rail pressure sensor 35 is determined as an abnormal or failed. The abnormality or failure of the common rail pressure sensor 35 can be determined by monitoring the output signal of the common rail pressure sensor 35. For example, the abnormality may be determined when the output signal of the common rail pressure sensor 35 is equal to or higher than a predetermined value. Alternatively, the abnormality may be determined when the common rail pressure Pc determined based on the basic pattern is equal to or higher than a predetermined value. For example, the abnormality may be determined when the output signal of the common rail pressure sensor 35 is equal to or higher than 5V. Further, a normal range of use of the output signal of the common rail pressure sensor 35 is, for example, 0.5V through 4.5V.

Next, a simple explanation will be given of a method of controlling the common rail fuel injection system according to the embodiment in reference to FIG. 1 through FIG. 4. Here, FIG. 3 and FIG. 4 are flowcharts showing the method of controlling the common rail fuel injection system.

Further, the flowcharts of the embodiment correspond to a control program stored to the memory and are started at a time point at which the ignition switch is switched as OFF→ON and the main relay is made ON to thereby supply the ECU power source from the battery to the ECU 10 and executed at any time at every predetermined time period. Further, when the ignition switch is switched as ON→OFF and the main relay is made OFF to thereby cut supply of the ECU power source to the ECU 10, the flowcharts are forcibly finished.

Figure 3:
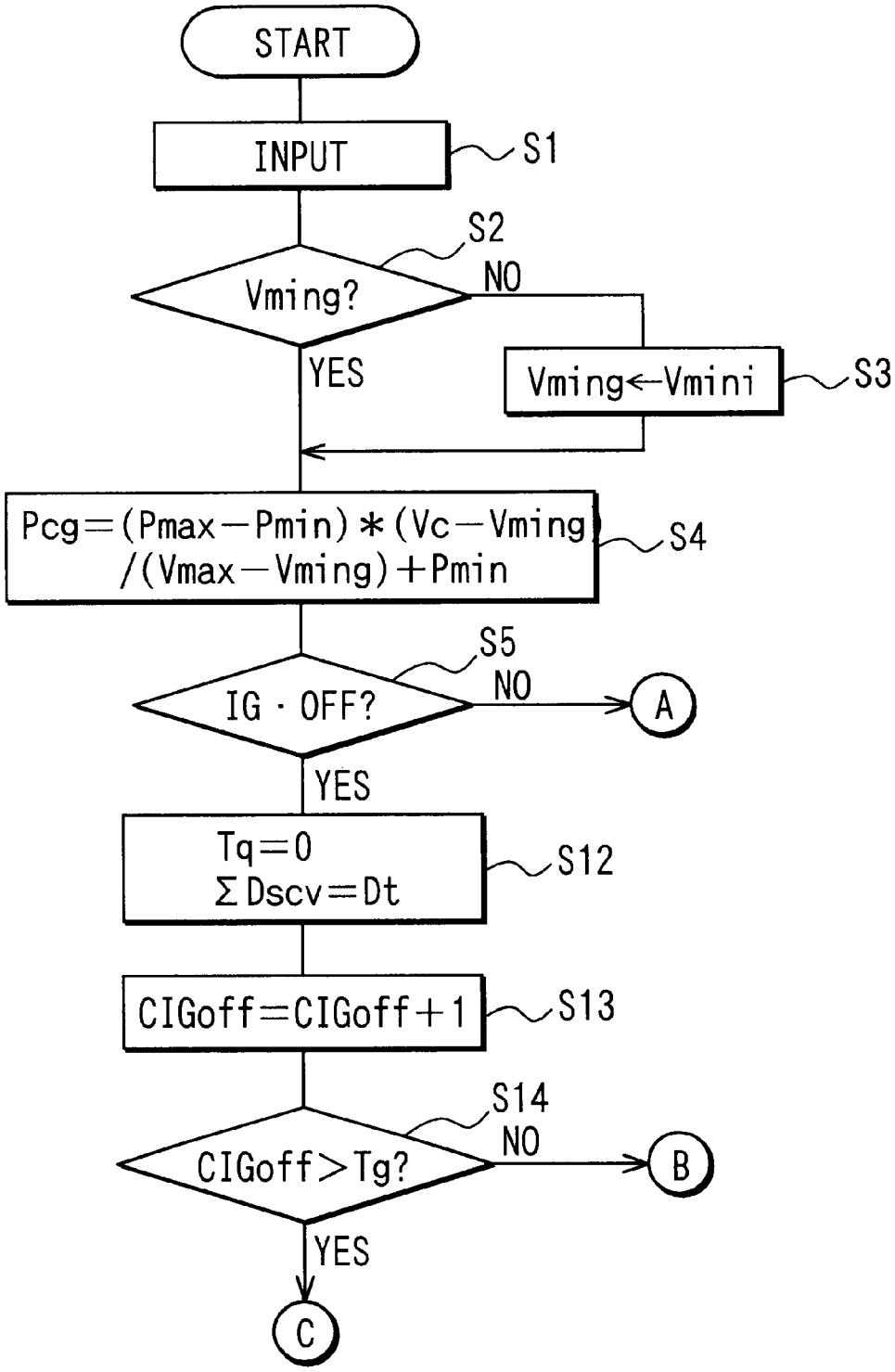
FIG. 3 is a flowchart showing a control method of the common rail fuel injection system according to the first embodiment of the present invention.
Figure 4:
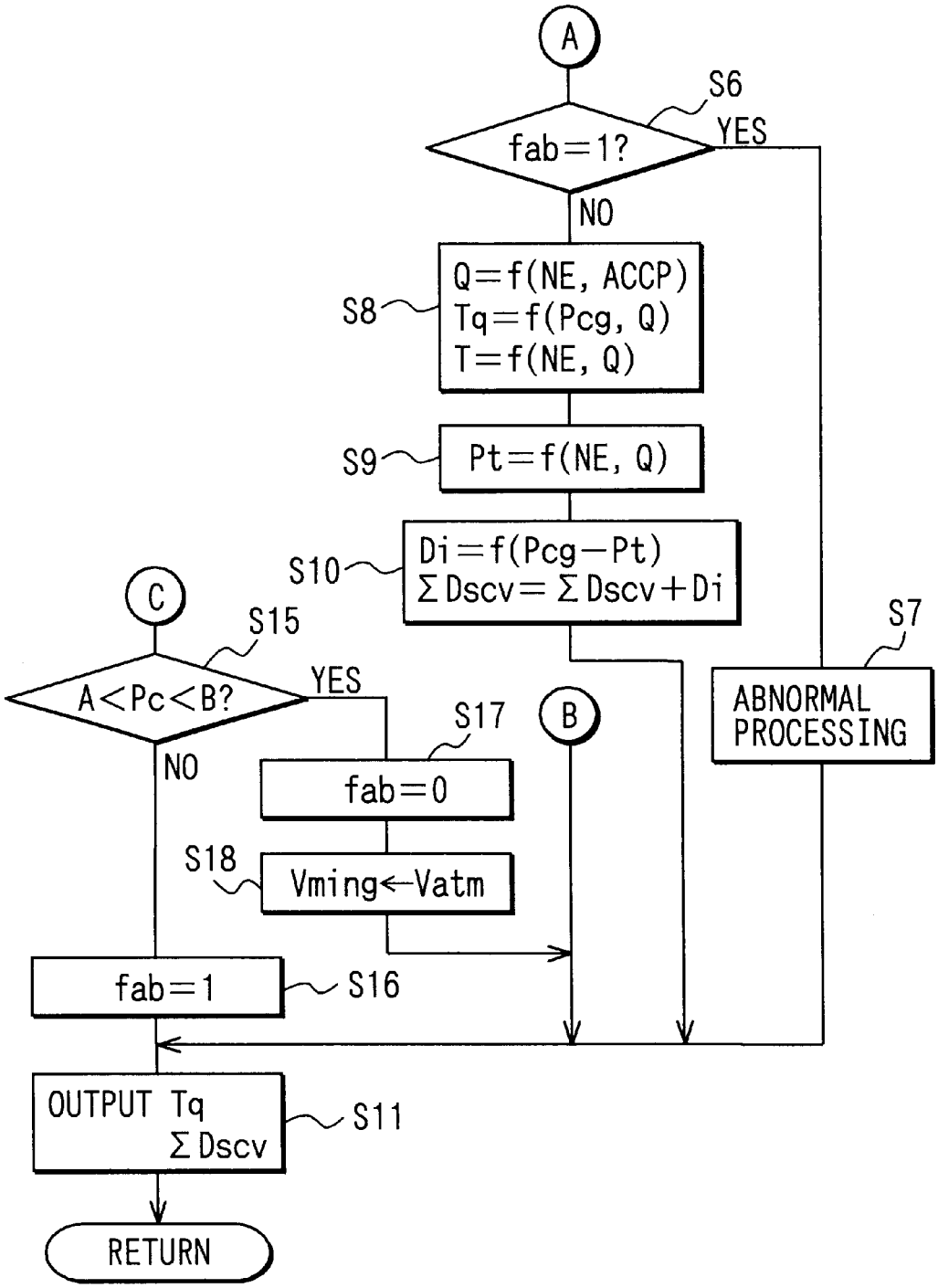
FIG. 4 is a flowchart showing a control method of the common rail fuel injection system according to the first embodiment of the present invention.

First, when the flowcharts of FIG. 3 and FIG. 4 are started, the ECU 10 executes step S1. The ECU 10 inputs operating condition or operating state of engine 1. In the embodiment, the engine rotational number NE, the accelerator opening degree ACCP, the engine cooling water temperature THW, the fuel temperature THF on the pump suction side which are engine parameters are inputted. At the same time, the common rail pressure output value Vc in correspondence with the common rail pressure PC before learning and correcting is inputted. The common rail pressure output value Vc is the output signal of the common rail pressure sensor 35 for detecting the actual common rail pressure PC.

Next, it is determined whether atmospheric pressure learning value Vming is set and stored to backup RAM (step S2.) The atmospheric pressure learning value vming is a learning data in correspondence with atmospheric pressure. When a result of the determination is YES, that is, when the atmospheric pressure learning value Vming is set and stored, the operation immediately proceeds to step S4. Further, when the result of the determination at step S2 is NO, that is, when the atmospheric pressure learning value vming is not set and stored, the operation proceeds to step S3. In step S3, an initial value Vmini in correspondence with atmospheric pressure previously stored to backup RAM is initially set as a learning value. The initial value Vmini may be referred to as a basic data in correspondence with the atmospheric pressure.

Next, in step S4, the common rail pressure output value Vc inputted at step S1 is converted into a pressure value, that is a common rail pressure after learning and correcting Pcg based on Equation (1). The common rail pressure after learning and correcting Pcg is stored to the backup RAM. This step is executed as means for changing or means for correcting the output voltage characteristic.

$$Pcg=(P\max-P\min)\times(Vc-V\mathrm{ming})\ /(V\max-V\mathrm{ming})+P\min=(P\max-1)\times(Vc-V\mathrm{ming})\ /(V\max-V\mathrm{ming})+1 \quad (1)$$

wherein Vming is the atmospheric pressure leaning value (learning data in correspondence with atmospheric pressure), Vmax is the maximum value which is an aimed value on the high pressure side in a normally used detection range as a detected value of the common rail pressure sensor 35, Pmax is a maximum pressure value in the normally used detection range as a detected value of the common rail pressure sensor 35, and Pmin is a minimum pressure value in the normally used detection range as a detected value of the common rail pressure sensor 35.

Here, Pmin is about 1 kg/cm$^2$ for learning and changing the sensor learning value Vming in correspondence with atmospheric pressure.

Further, Equation (2) described below, is an equation of calculating a pressure value before learning and correcting Pc.

$$Pc=(P\max-P\min)\times(Vc-V\mathrm{mini})\ /(V\max-V\mathrm{mini})+P\min=(P\max-1)\times(Vc-V\mathrm{mini})\ /(V\max-V\mathrm{mini})+1 \quad (2)$$

Next, in step S5, it is determined whether the ignition switch 7 is made OFF. The OFF state of the ignition switch 7 is referred to as an IG/OFF. When a result of the determination is NO, that is, when it is determined that the ignition switch 7 is in an IG/ON, it is determined whether an abnormality determining flag fab is flagged. In step S6, if the flag fab=1, it is determined that the flag is flagged. When the result of determination is YES, that is, when abnormality is determined and fab=1, an abnormal time processing is executed in step S7. Next, the operation proceeds to step S11.

Here, the abnormality time processing is operation of switching from the feedback control for controlling the delivery amount of the supply pump 4 to an open control for controlling the delivery amount of the supply pump 4 based on the engine parameters of the engine rotational number NE and the like and the basic injection amount Q such that the actual common rail pressure Pcg substantially coincides with the target common rail pressure Pt. Here, the actual common rail pressure Pcg is the pressure value after correction.

Further, when the result of determination at step s6 is NO, that is, when there is not the abnormality determination, the basic injection amount Q, the instructed injection amount QFIN, the injector injection pulse time period Tq and the instructed injection timing T are calculated on the base of the engine parameters. The injector injection pulse time period Tq is an injection pulse width of injector injection pulse. Specifically, the basic injection amount Q is calculated from the above-described engine rotational number NE and the above-described accelerator opening degree ACCP. Then, the instructed injection amount QFIN is calculated by adding the injection amount corrected value to the basic injection amount Q.

Further, the common rail pressure Pcg after learning and correcting calculated at step S4, mentioned above, and stored to the backup RAM, is read as the actual common rail pressure. The injector injection pulse time period Tq is calculated from the actual common rail pressure Pcg and the above-described instructed injection amount QFIN. The injector control instructed value Tq is the electricity conducting time period of the injector 3. Further, the instructed injection timing T is calculated from the above-described engine rotational number NE and the above-described instructed injection amount QFIN in step S8. Next, the target common rail pressure Pt is calculated on the basis of the engine parameters. Specifically, the target common rail pressure Pt is calculated from the above-described engine rotational number NE and the above-described instructed injection amount QFIN in step S9.

Next, the common rail pressure Pcg after learning and correcting calculated at step S4, mentioned above, and stored to the backup RAM, is read as the actual common rail pressure. An SCV correction amount Di is calculated in accordance with a pressure deviation between the actual common rail pressure Pcg and the above-described target common rail pressure Pt. The pressure deviation may be expressed as Pcg-Pt. Next, an SCV control amount ΣDscv at current time is calculated by summing the SCV correction amount Di to an SCV control amount ΣDscv at preceding time in step S10. The SCV control amount ΣDscv is an SCV control instructed value.

Next, the injector control amount and the instructed injection timing T are set to an output stage of the ECU 10. The injector control amount includes the injector control instructed value Tq. Further, the SCV control amount is set to the output stage of the ECU 10 in step S11. The SCV control amount includes the SCV control instructed value ΣDscv. Thereafter, the operation returns to step S1 and repeats the above-described control.

Further, when the result of determination at step S5 is YES, that is, the IG/OFF is determined, an engine stop time control amount is calculated. Specifically, the injector injection pulse time Tq which is a control amount of the injector 3 is set to null. Therefore, Tq=0. Further, a control amount ΣDscv of the SCV 5 is set to Dt in step S12. Therefore, the SCV control amount ΣDscv=Dt.

Next, an elapse time period after IG/OFF is counted up in step S13. A counter indicative of the elapse time period after IG/OFF is expressed as CIGoff=CIGoff+1. Next, it is determined whether abnormality can be determined. That is, in step S14, it is determined whether the predetermined time period Tg has elapsed after stopping the engine 1. The determination is carried out based on the expression CIGoff>Tg. When the result of determination is No, that is, when it is determined that the predetermined time period has not elapsed after stopping the engine, the operation directly proceeds to step S11 and the engine stop time control amount set at step S12 is set to the output stage of the ECU 10 at step S11. Thereafter, the operation returns to step S1 and repeats the above-described control.

Here, although the above-described predetermined time period Tg is a time period necessary for lowering the common rail pressure to the pressure in correspondence with the atmospheric pressure after stopping the engine, the predetermined time period Tg may be a time period until an amount of lowering the engine cooling water temperature or the suction temperature or the fuel temperature or the engine oil temperature is equal to or larger than a predetermined value after stopping the engine. Because when the amount of lowering the engine cooling water temperature or the suction temperature or the fuel temperature or the engine oil temperature becomes equal to or larger than the predetermined value, the common rail pressure seems to be firmly lowered down to the pressure in correspondence with atmospheric pressure.

Further, when the result of determination at step S14 is YES, that is, when it is determined that the predetermined time period has elapsed after stopping the engine, it is determined that an abnormal state of the common rail pressure sensor 35 can be determined and the operation proceeds to step S15. That is the ECU 10 determines that a failure diagnosis can be carried out. In step S15, it is determined whether the common rail pressure Pc before learning and correcting falls in a level range in correspondence with atmospheric pressure. The range in correspondence with atmospheric pressure is defined with a lower limit A and an upper limit B. The determination is carried out based on the expression A<Pc<B. Further, in determining the level range in correspondence with atmospheric pressure, other than the common rail pressure Pc before learning and correcting, the common rail pressure Pcg after learning and correcting or the common rail pressure output value Vc which is the output signal of the common rail pressure sensor 35 may be used.

When a result of determination at step S15 is NO, that is, the common rail pressure Pc before learning and correcting does not fall in the level range in correspondence with the atmospheric pressure, the operation proceeds to step S16. In step S16, it is determined that the common rail pressure sensor 35 is abnormal, that is, the common rail pressure Pc before learning and correcting is an abnormal value, the abnormality determining flag fab is flagged to be fab=1 and stored to backup RAM. Thereafter, at step S11, the engine stop time control amount set at step S12 is set to the output stage of the ECU 10. Thereafter, the operation returns to step S1 and repeats the above-described control.

Further, when the result of determination at step S15 is YES, that is, when the common rail pressure Pc before learning and correcting falls in the predetermined range, the operation proceed to step S17. In the step S17, it is determined that the common rail pressure sensor 35 is normal, that is, the common rail pressure Pc before learning and correcting is a normal value, the abnormality determining flag fab is not flagged to be fab=0 and stored to the backup RAM. Next, a common rail pressure output value Vatm in correspondence with atmospheric pressure inputted at current time, is set as the atmospheric pressure learning value Vming and stored to backup RAM in step S18. A value of atmospheric pressure is about 1 kg/cm$^2$. Thereafter, at step S11, the engine stop time control amount set at step S12 is set to the output stage of the ECU 10. Thereafter, the operation returns to step S1 and repeats the above-described control.

As described above, according to the common rail fuel injection system of the embodiment, when the predetermined time period has elapsed after stopping the engine, the common rail pressure output value vatm in correspondence with atmospheric pressure outputted from the common rail pressure sensor 35, is set as the atmospheric pressure learning value Vming and the output characteristic of the common rail pressure sensor 35 is changed from the basic pattern to the pattern after leaning. Specifically, as shown by the one-dotted chain line in the characteristic diagram of FIG. 2, the basic pattern of the output characteristic of the common rail pressure sensor 35, is corrected by learning to the pattern after learning of the output characteristic of the common rail pressure sensor 35 such that the inclination is significantly (or insignificantly) changed to pass two points of the learning value Vming in correspondence with the atmospheric pressure when the engine is stopped and the above-described maximum value Vmax.

That is, the deviation of the characteristic from the basic pattern of the output characteristic of the single product per se of the common rail pressure sensor 35 is corrected by learning and the common rail pressure Pcg after learning and correcting in correspondence with the common rail pressure output value Vc which is the detected value of the common rail pressure sensor 35, is reflected to control of the common rail pressure thereafter. Specifically, there is carried out the common rail pressure control (feedback control) for controlling the delivery amount of the supply pump 4 in accordance with the pressure deviation (Pcg-Pt) between the actual common rail pressure Pcg and the target common rail pressure Pt by inputting the common rail pressure Pcg after learning and correcting as the actual common rail pressure.

Thereby, the deviation of the characteristic from the basic pattern of the single product per se of the common rail pressure sensor 35 can be corrected by learning by learning control of the ECU 10 without guaranteeing accuracy in fabricating the common rail pressure sensor 35 and therefore, the fabrication cost of the common rail pressure sensor 35 can considerably be reduced. At the same time, control accuracy of injection amount control and common rail pressure control in the common rail fuel injection system can considerably be improved while considerably reducing the fabrication cost of the common rail pressure sensor 35 in this way.

Here, according to the embodiment, as shown by the one-dotted chain line in the characteristic diagram of FIG. 2, the pattern after learning of the output characteristic of the common rail pressure sensor 35 is constituted by the output characteristic after learning and correcting which passes two points of the learning value vming in correspondence with atmospheric pressure when the engine is stopped and the maximum value Vmax in the normally used range of the output characteristic of the common rail pressure sensor 35 and is raised to the right. This is, there is constituted the output characteristic significantly inclining the inclination of the basic pattern of the output characteristic of the common rail pressure sensor 35 shown by the bold line in the characteristic diagram of FIG. 2.

Further, although there is shown the output characteristic raised to the right in which the learning value Vming in correspondence with atmospheric pressure when the engine is stopped, is larger than the initial value vmini in correspondence with atmospheric pressure when the engine is stopped, there may naturally be provided an output characteristic raised to the right in which the learning value Vming in correspondence with the atmospheric pressure when the engine is stopped, is smaller than the initial value Vmini in correspondence with atmospheric pressure when the engine is stopped by a deviation in the output characteristic of the common rail pressure sensor 35.

Here, when the pattern after learning of the output characteristic of the common rail pressure sensor 35 is constituted by an output characteristic raised to the right, which is in parallel with the basic pattern of the output characteristic of the common rail pressure sensor 35 shown by the bold line in the characteristic of FIG. 2 and passes the above-described learning value Vming which is larger or smaller than the above-described initial value Vmini, the common rail pressure Pcg after learning and correcting in correspondence with the common rail pressure output value Vc which is the detected value of the common rail pressure sensor 35, is significantly different from the common rail pressure Pc before learning and correcting of the basic pattern.

Particularly, according to the embodiment, in operating the engine, when the common rail pressure output value Vc which is the detected value of the common rail pressure sensor 35, is equal to or higher than an abnormal value (for example, 5V), the common rail pressure sensor 35 is determined as abnormal (failed) and operation of the engine 1 is stopped and therefore, in the case in which there is constituted a pattern after learning in parallel with the above-described basic pattern and having an output characteristic larger than the above-described initial value Vmini, even when the common rail pressure output value Vc which is the detected value of the common rail pressure sensor 35, is equal to or higher than the abnormal value, the common rail pressure Pcg after learning and correcting becomes a value lower than pressure in correspondence with the abnormal value and there causes a drawback in controlling the common rail fuel injection system.

Further, there is conceivable a system in which when the common rail output value Vc which is the detected value of the common rail pressure sensor 35 is equal to or lower than an abnormal value (for example, 0V) in operating the engine, the common rail pressure sensor 35 is determined to be abnormal (failed) and operation of the engine 1 is stopped. In this case, when there is constituted a pattern after learning in parallel with the above-described basic pattern and having an output characteristic smaller than the above-described initial value Vmini, even in the case in which the common rail pressure output value Vc which is the detected value of the common rail pressure sensor 35, is equal to or lower than an abnormal value, the common rail pressure Pcg after learning and correcting becomes a value higher than pressure in correspondence with the abnormal value and a drawback is caused in controlling the system.

The pattern after learning of the invention is constituted by an apparent output characteristic and therefore, even when the output characteristic of the common rail pressure sensor 35 is actually provided with an output characteristic in parallel with the basic pattern as mentioned above, in order to avoid the drawback in controlling the system, as shown by the one-dotted chain line in the characteristic diagram of FIG. 2, there is constituted the output characteristic raised to the right, which passes two points of the learning value Vming in correspondence with atmospheric pressure when the engine is stopped and the maximum value (Vmax) in the normally used range of the output characteristic of the common rail pressure sensor 35.

Second Embodiment

Figure 5:
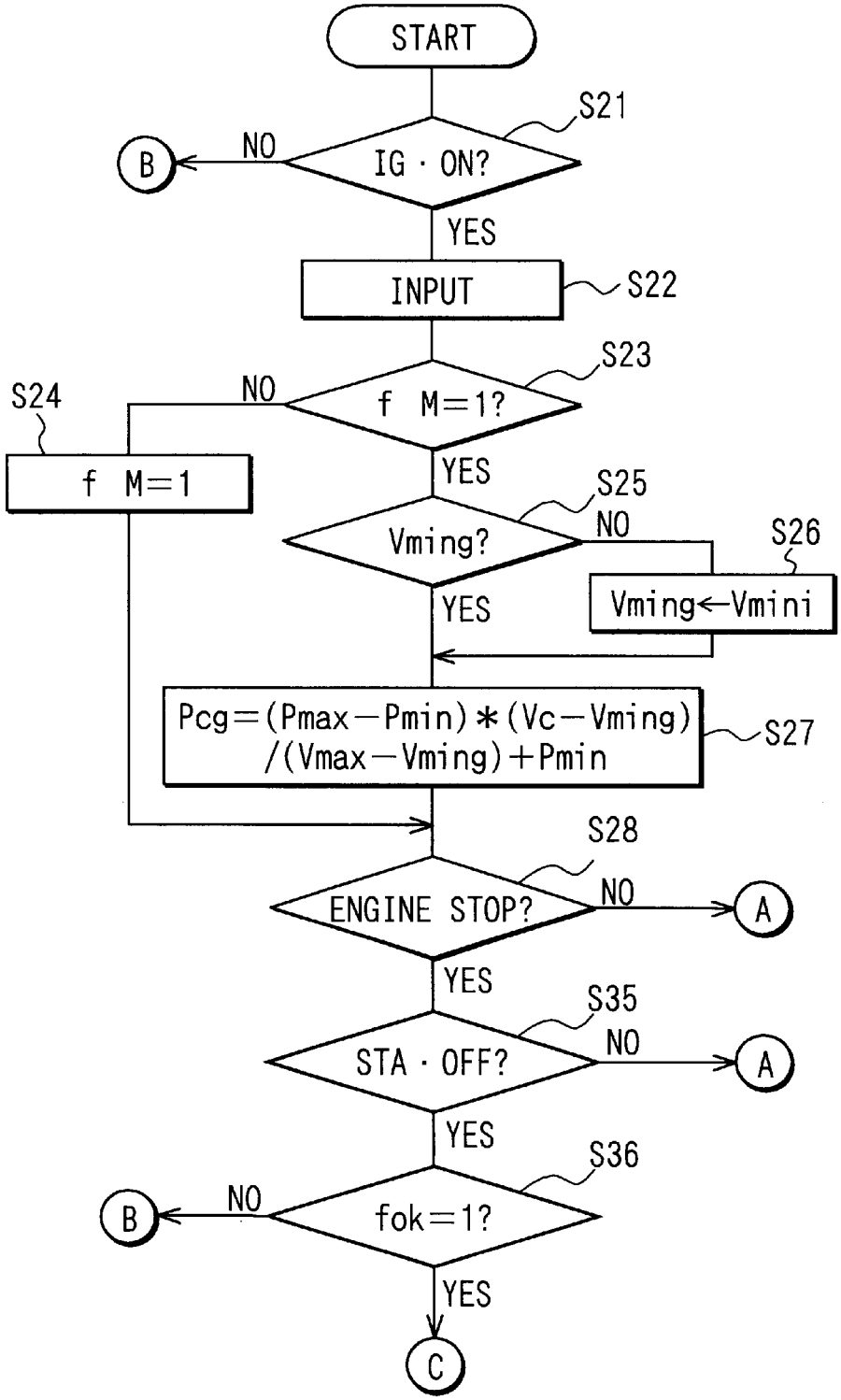
FIG. 5 is a flowchart showing a control method of the common rail fuel injection system according to a second embodiment of the present invention.
Figure 6:
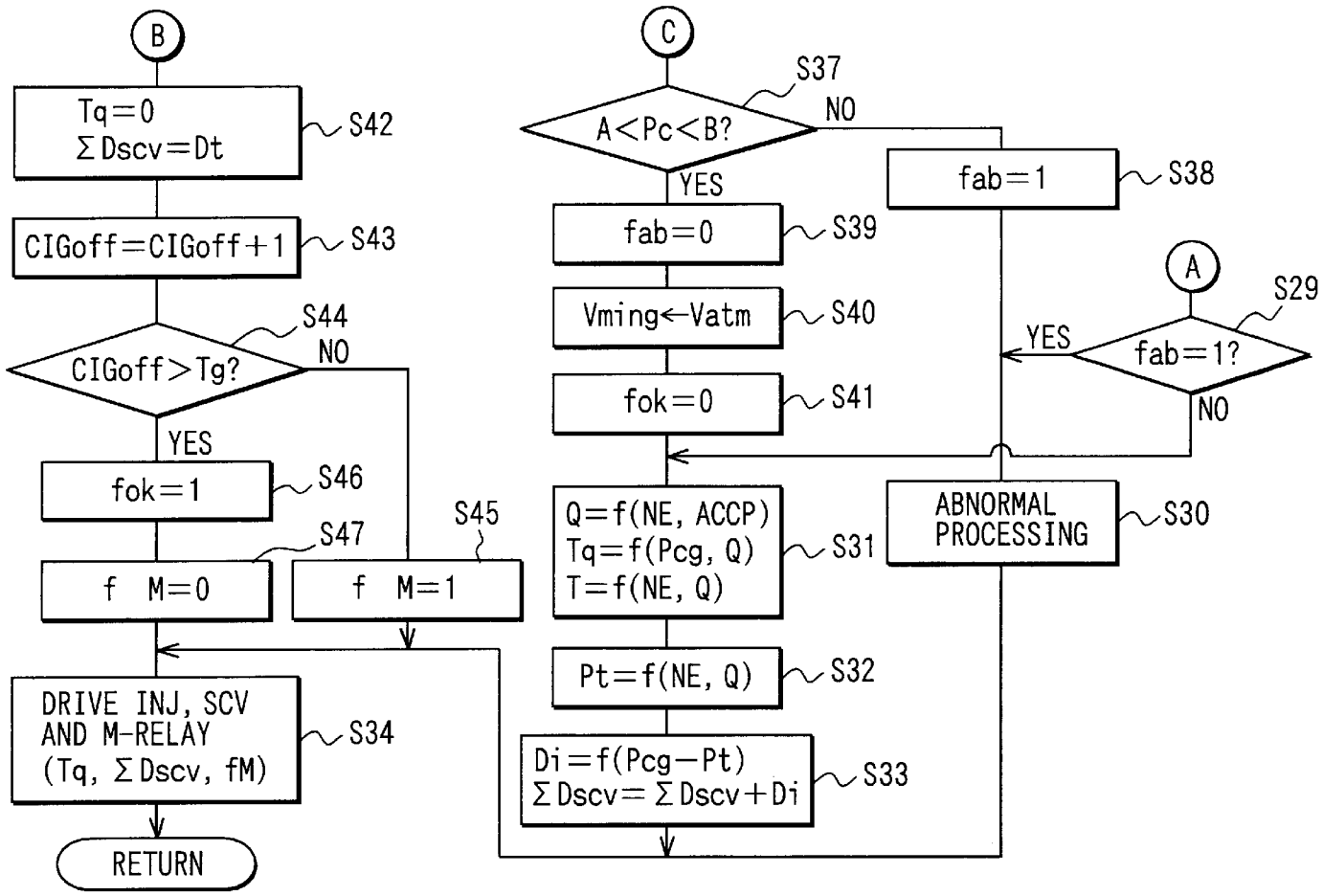
FIG. 6 is a flowchart showing a control method of the common rail fuel injection system according to the second embodiment of the present invention.
Figure 7:
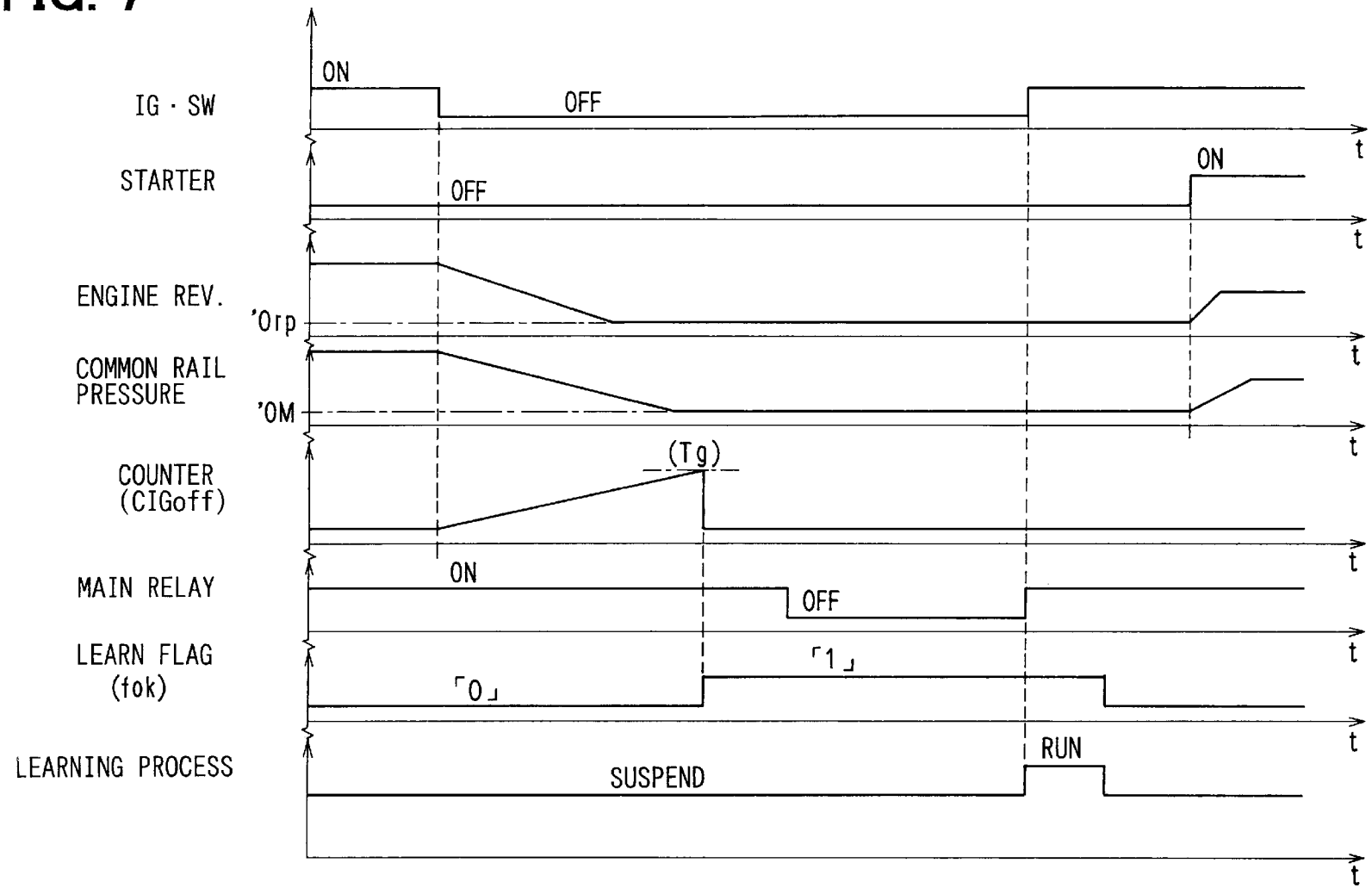
FIG. 7 is a timing chart showing behaviors of the common rail type fuel injection system according to the second embodiment of the present invention.

FIG. 5 through FIG. 7 show a second embodiment of the invention.

First, it is determined whether the ignition switch 7 is made ON. A state where the ignition switch 7 is turned on is referred to as an IG/ON. That is, it is determined whether the IG/ON signal is detected by the IG/ON signal detecting function of the ECU 10 (at step S21). When a result of the determination is YES, that is, in the case of IG/ON, similar to the first embodiment, the engine parameters (operating condition or operating state of engine 1) are inputted (step S22). Next, it is determined whether the main relay is made ON. That is, it is determined whether a main relay control flag fM is flagged (set to 1) (step S23). When a result of the determination is NO, the main relay control flag fM is set to an ON value (fM=1) such that the main relay is made ON in synchronism with ON of the ignition switch (IG/ON) (step S24). Thereafter, the operation immediately proceeds to step S28.

Further, when the result of determination at step S23 is YES, that is, when the main relay is made ON, similar to the first embodiment, it is determined whether the atmospheric pressure learning value Vming is set and stored (step S25). When a result of the determination is YES, the operation immediately proceeds to step S27.

Further, when the result of determination at step S23 is NO, the initial value Vmini of the sensor output value in correspondence with atmospheric pressure previously stored in backup RAM is initially set as the learning value (atmospheric pressure learning value: Vming) (step S26). Next, similar to the first embodiment, the pressure value after learning and correcting (learning value, common rail pressure after learning and correcting: Pcg) is calculated based on Equation (1), mentioned above, and the common rail pressure after learning and correcting Pcg is stored to backup RAM (step S27). This step functions as a part of the output characteristic changing means.

Next, it is determined whether the engine is stopped. That is, it is determined whether the engine rotational number NE detected by the rotational speed sensor 31 is equal to or smaller than a predetermined value (for example, 0 rpm) (step S28). When a result of the determination is NO, it is determined whether the abnormality determining flag fab is flagged (fab=1) (step S29). When the result of determination is YES, that is, when abnormality is determined and fab=1, similar to the first embodiment, the abnormal time processing is executed (step S30). Next, the operation proceeds to step S34.

Further, when the result of determination at step S29 is NO, that is, when abnormality is not determined, similar to the first embodiment, the basic injection amount Q, the instructed injection amount QFIN, the injector injection pulse time period Tq and the instructed injection timing T are calculated on the base of the engine parameters (step S31). Next, similar to the first embodiment, the target common rail pressure Pt is calculated on the base of the engine parameters (step S32).

Next, similar to the first embodiment, the common rail pressure after learning and correcting Pcg calculated at step S26, mentioned above, and stored to backup RAM is read as the actual common rail pressure and the SCV correction amount Di is calculated in accordance with the pressure deviation Pcg-Pt between the actual common rail pressure Pcg and the abovedescribed target common rail pressure Pt. Next, The SCV control amount (SCV control instructed value: ΣDscv) at current time is calculated by summing the SCV correction amount D1 to the scv control amount ΣDscv at preceding time (step S33). Next, similar to the first embodiment, the INJ control amount Tq and the instructed injection timing T are set to the output stage of the ECU 10 and the SCV control amount ΣDscv is set to the output stage of the ECU 10. Further, the main relay output value (fM=1 or fM=0) is set (step S34). Thereafter, the operation returns to step S21 and repeats the above-described control.

Further, when the result of determination at step S28 is YES, that is, when the engine is stopped, it is determined whether the starter for starting the engine is made OFF. That is, it is determined whether a starter relay of a starter electricity conducting circuit for controlling to conduct electricity to the starter is made OFF (step S35). A state where the starter 9 is turned OFF is referred to as an STA/OFF. When a result of the determination is NO, that is, when the starter relay is made ON, the operation proceeds to step S29. A state where the starter 9 is turned ON is referred to as an STA/ON.

Further, when the result of determination at step S35 is YES, that is, when the starter relay is made OFF (STA/OFF), it is determined whether a learning permitting flag fok is flagged (set to fok=1) (step S36). When a result of the determination is YES, that is, when the flag is set to fok=1, similar to the first embodiment, it is determined whether the common rail pressure before learning and correcting Pc falls in the level range in correspondence with atmospheric pressure (A<Pc<B) (step S37). When a result of the determination at step S37 is NO, that is, when the common rail pressure before leaning and correcting Pc does not fall in the level range in correspondence with atmospheric pressure, similar to the first embodiment, it is determined that the common rail pressure sensor 35 is abnormal, that is, the common rail pressure before learning and correcting Pc is an abnormal value, the abnormality determining flag fab is flagged to be fab=1 and stored to backup RAM (step S38). Thereafter, the operation proceeds to step S30.

Further, when the result of determination at step S37 is YES, that is, the common rail pressure before learning and correcting Pc falls in a predetermined range, the abnormality determining flag fab is canceled (fab=0) (step S39). Next, the common rail pressure output value Vatm in correspondence with atmospheric pressure (value of atmospheric pressure state of about 1 kg/cm$^2$) inputted at current time, is set as the atmospheric pressure learning value Vming and stored to backup RAM (step S40). Next, the learning permitting flag fok is reset (fok=0) (step S41). Thereafter, the operation proceeds to step S31.

Further, when the result of determination at step S21 or step S36 is NO, that is, when the ignition switch is made OFF (IG/OFF), or when the learning permitting flag fok is reset (fok=0), similar to the first embodiment, the engine stop time control amount is calculated (step S42). Next, similar to the first embodiment, the elapse time after IG/OFF is counted up (step S43).

Next, whether a state capable of determining abnormality is determined. That is, it is determined whether a predetermined time period Tg has elapsed after making the ignition switch OFF (IG/OFF) (CIGoff>Tg) (step S44). When a result of the determination is NO, that is, when it is determined that the predetermined time period has not elapsed after stopping the engine, the main relay control flag fM is set to the ON value (fM=1) to continue the ON state of the main relay; (step S45). Thereafter, at step. S34, the engine stop time control amount set at step S42 is set to the output stage of the ECU 10. Thereafter, the operation returns to step S21 and repeats the above-described control.

Further, when the result of determination at step S44 is YES, that is, when it is determined that the predetermined time period has elapsed after stopping the engine, the state capable of determining abnormality is determined and the learning permitting flag fok is flagged and set to fok=1 (step S46). Next, the main relay control flag fM is set to the OFF value (fM=0) to make the main relay OFF in accordance with OFF of the ignition switch (IG/OFF) (step S47). Thereafter, at step S34, the engine stop time control amount set at step S42 is set to the output stage of the ECU 10. Thereafter, the operation returns to step S21 and repeats the above-described control.

As described above, according to the common rail fuel injection system of the embodiment, when the engine is started after the predetermined time period has elapsed after stopping the engine, that is, as shown by FIG. 7, when the predetermined time period Tg has elapsed after making the ignition switch OFF by returning the engine key from the IG position to the OFF position (CIGoff>Tg), the counting by the counter after making the engine key OFF is finished and the learning permitting flag fok is made ON (fok=1).

Thereafter, when the main relay is switched from the ON state to the OFF state to thereby cut supply of the ECU power source and thereafter a passenger makes the ignition switch ON (IG/ON) by turning the engine key from the OFF position to the IG position, in synchronism therewith, the main relay is brought into the ON state and the ECU power source is supplied to the ECU 10.

At this occasion, when the engine is started while the ignition switch is made ON (IG/ON), the learning permitting flag fok is made ON (fok=1), the starter relay is made OFF (STA/OFF), the common rail pressure output value Vatm in correspondence with atmospheric pressure (value of atmospheric pressure state of about 1 $kg/cm^2$) outputted from the common rail pressure sensor 35, is set as the atmospheric pressure learning value Vming and the output characteristic of the common rail pressure sensor 35 is changed from the basic pattern to the pattern after learning.

Thereby, similar to the first embodiment, the deviation of the characteristic from the basic pattern of the single product per se of the common rail pressure sensor 35 can be learnt and corrected by the learning control of the ECU 10 without guaranteeing accuracy in fabricating the common rail pressure sensor 35 and therefore, a considerable reduction in cost of fabricating the common rail pressure sensor 35 can be achieved. At the same time, the control accuracy of the injection amount control and the common rail pressure control of the common rail fuel injection system can considerably be improved.

Here, when the learning permitting flag fok is operated in cooperation with a warning lamp installed at a front face of inside of the vehicle compartment, the operation is facilitated as follows. That is, in the case in which the warning lamp is switched ON when the engine key is turned from the OFF position to the IG position, this is the case in which the learning permitting flag fok is made ON (fok=1), and when the warning lamp is switched OFF thereafter, it is determined that learning and correcting has been finished, the engine key is turned from the IG position to the ST position, the starter is operated and the engine 1 is cranked. Thereby, the engine 1 can be started firmly after executing learning and correcting for changing the output characteristic of the common rail pressure sensor 35.

Here, according to the embodiment, there may include a case of starting the engine after elapse of the predetermined time period after stopping the engine and a case of starting the engine after the fuel pressure is lowered to the atmospheric pressure after stopping the engine or after an amount of lowering the engine cooling water temperature or the intake temperature or the fuel temperature or the engine oil temperature becomes equal to or larger than a predetermined value after stopping the engine. Further, the timing of starting the engine includes a timing in which the engine key is inserted into the key cylinder in the vehicle compartment and turned from the OFF position to the IG position and thereafter the engine key is turned to the ST position to thereby crank the engine 1.

Other Embodiment

Although according to the embodiments described above, the common rail pressure sensor 35 is directly attached to the common rail 2 and the fuel pressure accumulated in the common rail 2 (actual common rail pressure) is detected, the fuel pressure sensor may be attached to a fuel pipe or the like from the plunger chamber (pressurizing chamber) of the supply pump 4 to the fuel path at inside of the injector 3 for detecting pressure of fuel delivered from the pressurizing chamber of the supply pump 4 or the fuel injection pressure of fuel injected to supply into the combustion chamber of the respective cylinder of the engine 1.

Although according to the embodiments described above, an explanation has been given of an example of providing the suction control valve (suction amount controlling electromagnetic valve) 5 for changing (controlling) the suction amount of the fuel sucked into the plunger chamber (pressurizing chamber) of the supply pump 4, there may be provided a delivery amount controlling electromagnetic valve for changing (controlling) the delivery amount of the fuel from the plunger chamber (pressurizing chamber) of the supply pump 4 to the common rail 2.

Although according to the embodiments described above, there is used the suction control valve 5 of the normally open type in which the valve opening degree is fully opened when electricity conduction to the electromagnetic valve is stopped, there may be used a delivery amount controlling electromagnetic valve of a normally open type in which the valve opening degree is fully opened when electricity conduction to the electromagnetic valve is stopped. Further, there may be used an electromagnetic valve of a normally close type in which the valve opening degree of the delivery amount controlling electromagnetic valve or the suction amount controlling electromagnetic valve is fully opened when electricity is conducted to the electromagnetic valve.

Although according to the embodiments described above, as output characteristic storing means, there is used standby RAM for storing a content of leaning even when the ignition switch is made OFF (IG/OFF), standby RAM may not be used but other storage medium of involatile memory of EPROM, EEPROM, flash memory or the like, DVD-ROM, CD-ROM or flexible disk may be used. Also in this case, the content of learning is held even when supply of the ECU power source from the battery is stopped in IG/OFF.

Although according to the embodiments described above, the pattern after learning of the output characteristic of the common rail pressure sensor 35 is constituted by the output characteristic raised to the right passing two points of the learning value Vming in correspondence with the atmospheric pressure inputted when the engine is stopped and the maximum value Vmax in the normally used range of the output characteristic of the common rail pressure sensor 35, the pattern after learning of the output characteristic of the common rail pressure sensor 35 may be constituted by an output characteristic raised to the right passing two points of the learning value Vming in correspondence with atmospheric pressure when the engine is stopped and a high pressure side aimed value ($Vmax<Vx<Vmax+\alpha$, $\alpha$ is a tolerance) in the normally used range of the output characteristic of the common rail pressure sensor 35 to thereby prevent the actual common rail pressure from exceeding the target value on the high pressure side. Further, the pattern after learning of the output characteristic of the common rail pressure sensor 35 may be constituted by an output characteristic after learning and correcting in which the inclination is changed to pass two points of the learning value Vming in correspondence with atmospheric pressure inputted when the engine is stopped and a value of an upper side of a high pressure side aimed value in the normally used range of the output characteristic of the common rail pressure sensor 35.

Further, in order to improve starting performance of the engine, there may be constructed a constitution in which electricity starts conducting to the solenoid coil of the suction control valve 5 simultaneously with inserting the engine key to the key cylinder in the vehicle compartment and turning the engine key from the OFF position to the IG position, that is, simultaneously with making the ignition switch ON (IG/ON). In this case, the valve of the suction control valve 5 can be set to a valve opening degree capable of obtaining a fuel amount or fuel injection pressure necessary for starting the engine 1 immediately when electricity is conducted to the starter for starting the engine 1. Further, a remote control engine starter system may be used.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel injection system, comprising:

a fuel pressure sensor which outputs an output signal indicative of a fuel pressure, the output signal and the fuel pressure defining an actual pattern of the output characteristic; and a controller which controls at least one of the components of the fuel injection system in response to the output signal of the fuel pressure sensor, wherein the controller includes:

learning means for learning the actual pattern of the output characteristic of the fuel pressure sensor based on the output signal corresponding to an atmospheric pressure which is outputted when the fuel pressure is expected to be lowered to an atmospheric pressure; and correcting means for correcting a control characteristic between the output signal and a control signal for the component based on the actual pattern of the output characteristic learned in the learning means.

2. The fuel injection system according to claim 1, wherein the output signal corresponding to the atmospheric pressure is outputted while the engine is stopped.

3. The fuel injection system according to claim 2, wherein the output signal corresponding to the atmospheric pressure is outputted while the engine is stopped and a predetermined condition is satisfied.

4. The fuel injection system according to claim 3, wherein the predetermined condition is satisfied when:

the fuel pressure is lowered to an atmospheric pressure after stopping the engine, a predetermined time period is elapsed after stopping the engine, or an amount of lowering an engine cooling water temperature or an intake temperature or a fuel temperature or an engine oil temperature after stopping the engine is equal to or larger than a predetermined value.

5. The fuel injection system according to claim 4, wherein the output signal corresponding to the atmospheric pressure is outputted while the engine is stopped and in starting the engine after the predetermined condition is satisfied.

6. The fuel injection system according to claim 1, wherein the correcting means includes:

output characteristic storing means for storing the output characteristic of the fuel pressure sensor, the controller being responsive to the output characteristic stored in the output characteristic storing means; and output characteristic changing means for changing the output characteristic based on the output characteristic learned in the learning means.

7. The fuel injection system according to claim 6, wherein the output characteristic storing means initially stores a basic pattern of the output characteristic, and the output characteristic changing means changes the output characteristic from the basic pattern to a learned pattern.

8. The fuel injection system according to claim 1, further comprising:

a fuel pump which pressurizes fuel;

a common rail connected to the fuel pump, which accumulates a high pressure fuel pressurized by the fuel pump; and an injector connected to the common rail, which supply high pressure fuel accumulated in the common rail, wherein the fuel pressure sensor is connected to the common rail and responsive to the fuel pressure accumulated in the common rail, and wherein the learning means inputs a learned output signal that is the output signal of the fuel pressure sensor when the fuel pressure is lowered to an atmospheric pressure after stopping the engine, or when a predetermined time period is elapsed after stopping the engine, or when an amount of lowering an engine cooling water temperature or an intake temperature or a fuel temperature or an engine oil temperature after stopping the engine is equal to or larger than a predetermined value, and wherein the correcting means includes:

output characteristic storing means for storing a basic pattern of the output characteristic of the fuel pressure sensor; and output characteristic changing means changing the output characteristic of the fuel pressure sensor stored in the output characteristic storing means from the basic pattern to a pattern after learning using the learned output signal corresponding to the atmospheric pressure.

9. The fuel injection system according to claim 1, further comprising:

a fuel pump which pressurizes fuel;

a common rail connected to the fuel pump, which accumulates a high pressure fuel pressurized by the fuel pump; and an injector connected to the common rail, which supply high pressure fuel accumulated in the common rail, wherein the fuel pressure sensor is connected to the common rail and responsive to the fuel pressure accumulated in the common rail, and wherein the learning means inputs a learned output signal that is the output signal of the fuel pressure sensor in starting the engine after the fuel pressure has been lowered to an atmospheric pressure after stopping the engine, or after a predetermined time period has been elapsed after stopping the engine, or after an amount of lowering an engine cooling water temperature or an intake temperature or a fuel temperature or an engine oil temperature after stopping the engine has been equal to or larger than a predetermined value, and wherein the correcting means includes:

output characteristic storing means for storing a basic pattern of the output characteristic of the fuel pressure sensor; and output characteristic changing means changing the output characteristic of the fuel pressure sensor stored in the output characteristic storing means from the basic pattern to a pattern after learning using the learned output signal corresponding to the atmospheric pressure.

10. The accumulator fuel injection system according to claim 9, wherein:

the controller controls at least one of an injection amount and an injection time period of the injector, controls an injection timing of the injector and controls at least one of a delivery amount and a pressure-feed amount of the fuel pump, wherein the controller comprises:

ignition determining means for determining whether an ignition switch is made on;

starter determining means for determining whether electricity conduction to a starter is stopped; and learning permitting flag setting means for setting a learning permitting flag after a fuel pressure is lowered to the atmospheric pressure after stopping the engine, or after a predetermined time period is elapsed after stopping the engine; or after an amount of lowering the engine cooling water temperature or the intake temperature or the fuel temperature or the engine oil temperature becomes equal to or larger than a predetermined value after stopping the engine, and wherein the starting the engine in the learning means is a timing when the ignition switch is made on, electricity conduction to the starter is stopped and the learning permitting setting flag is made on.

11. The fuel injection system according to claim 8, characterized in that the output characteristic changing means converts the output signal of the fuel pressure sensor into a value after learning based on the pattern after leaning, and reflects the value after learning to a control thereafter during operating the engine.

12. The fuel injection system according to claim 11, characterized in that the control thereafter is a control for controlling at least one of a delivery amount and a pressure-feed amount of the fuel pump by a feedback control such that an actual common rail pressure detected by the fuel pressure sensor substantially coincides with a target common rail pressure determined in accordance with an operating condition or an operating state of the engine.

13. The fuel injection system according to claim 8, characterized in that the basic pattern of the output characteristic of the fuel pressure sensor is an output characteristic before learning which passes two points of an initial value corresponding to the atmospheric pressure and a high pressure side aimed value within a normally used range of the fuel pressure sensor.

14. The fuel injection system according to claim 13, characterized in that the pattern after leaning of the output characteristic has an inclination that is changed from that of the basic pattern to pass two points of the learned output signal corresponding to the atmospheric pressure and the high pressure side aimed value within the normally used range of the fuel pressure sensor.

15. The fuel injection system according to claim 13, characterized in that the pattern after learning of the output characteristic has an inclination that is changed to pass two points of the learned output signal corresponding to the atmospheric pressure and a value of an upper side of the high pressure side aimed value within the normally used range of the fuel pressure sensor.

* * * * *